US006750174B2

(12) United States Patent
Watanabe et al.

(10) Patent No.: US 6,750,174 B2
(45) Date of Patent: Jun. 15, 2004

(54) HEAT SENSITIVE RECORDING MATERIAL

(75) Inventors: Tsutomu Watanabe, Shizuoka-ken (JP); Hirofumi Mitsuo, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/003,360

(22) Filed: Dec. 6, 2001

(65) Prior Publication Data

US 2002/0111271 A1 Aug. 15, 2002

(30) Foreign Application Priority Data

Dec. 11, 2000 (JP) ..... 2000-376140

(51) Int. Cl.[7] ..... B41M 5/30
(52) U.S. Cl. ..... 503/208; 503/216
(58) Field of Search ..... 503/208, 209, 503/216

(56) References Cited

U.S. PATENT DOCUMENTS

| | | | |
|---|---|---|---|
| 4,888,321 | A | 12/1989 | Kawakami et al. |
| 5,705,452 | A | 1/1998 | Saito et al. |
| 5,840,652 | A | 11/1998 | Oda et al. |
| 6,040,470 | A | 3/2000 | Oda et al. |

FOREIGN PATENT DOCUMENTS

| | | |
|---|---|---|
| EP | 0 949 087 A1 | 10/1999 |
| JP | 8-198841 | 8/1996 |
| JP | 10-44616 | 2/1998 |
| JP | 11-342676 | 12/1999 |
| JP | 11-348430 | 12/1999 |
| JP | 2000-6530 | 1/2000 |
| JP | 2000-6533 | 1/2000 |
| JP | 2001-63227 | 3/2001 |

OTHER PUBLICATIONS

Patent Abstract of Japan, 11–342676, Dec. 14, 1999.
Patent Abstract of Japan, 08–198841, Aug. 6, 1996.
Patent Abstract of Japan, 10–044616, Feb. 17, 1998.
Patent Abstract of Japan, 11–348430, Dec. 21, 1999.
Patent Abstract of Japan, 2000–006533, Jan. 11, 2000.
Patent Abstract of Japan, 2000–006530, Jan. 11, 2000.

*Primary Examiner*—B. Hamilton Hess
(74) *Attorney, Agent, or Firm*—Sughrue Mion, PLLC

(57) ABSTRACT

The present invention provides a heat sensitive recording material which has high sensitivity and high degree of color formation, excellent storage stability in image portions and non-image portions (i.e., background portions), high whiteness in background portions, and can stably maintain a high contrast image for a long period of time. The heat sensitive recording material has, on a support, a heat sensitive color-forming layer having an electron donating colorless dye and an electron accepting compound. At least one type of the electron accepting compound is 2,4-bis(phenylsulfonyl) phenol, and the heat sensitive color-forming layer further has 2-naphthylbenzyl ether and an amide compound as thermally fusible substances.

7 Claims, No Drawings

HEAT SENSITIVE RECORDING MATERIAL

BACKGROUND OF THE INVENTION

1. Field of the Invention

The present invention relates to a heat sensitive recording material, and particularly to a heat sensitive recording material which has high degree of color formation and excellent storability.

2. Description of the Related Art

Heat sensitive materials, in which an image is recorded by, for example, a thermal head applying heat, are relatively inexpensive. Furthermore, image recording devices for such heat sensitive materials are simple, highly reliable, and need no maintenance. For these reasons, heat sensitive recording materials have been widely used in recent years.

There has thus been a strong demand recently for heat sensitive recording materials of higher performance such as higher image quality and improved storability in particular. Intensive research on the degree of color formation, image quality, and storability of the heat sensitive recording materials has been carried out.

For example, Japanese Patent Application Laid-Open (JP-A) No. 11-342676 discloses a heat sensitive recording body which contains 2,4-bis(phenylsulfonyl) phenol as a color agent (an electron accepting compound) causing color reaction with a leuko dye, is highly sensitive, and has excellent storability in recording portions (i.e., image portions). Although excellent in terms of storability (plasticizer resistance, water resistance, and oil resistance), the heat sensitive recording body has problems of storage stability (such as fog density and contrast of an image) in non-image portions (i.e., background portions).

As described above, at present, a heat sensitive recording material with which an image of high density is obtained, and which has excellent image storability (such as excellent plasticizer resistance, water resistance, and resistance to solvents) in image portions and excellent storage stability in non-image portions (background portions), has high whiteness, and can stably maintain an image of high contrast for a long period of time has not been provided.

SUMMARY OF THE INVENTION

An object of the present invention is to solve the above-described problems and achieve the following object.

Namely, an object of the present invention is to provide a heat sensitive recording material which has high sensitivity, high degree of color formation, and excellent storage stability (such as plasticizer resistance (resistance to solvents), water resistance, and heat resistance) in both image and non-image portions, has background portions of high whiteness, and can stably maintain an image of high contrast for a long period of time.

A first aspect of the present invention is a heat sensitive recording material which has, on a support, a heat sensitive color-forming layer having an electron donating colorless dye and an electron accepting compound, wherein at least one type of the electron accepting compound is 2,4-bis (phenylsulfonyl) phenol, and the heat sensitive color-forming layer also has 2-naphthylbenzyl ether and an amide compound as thermally fusible substances.

A second aspect of the present invention is a heat sensitive recording material wherein the content of an amide compound is 2 to 100 parts by mass with respect to 100 parts by mass of 2-naphthylbenzyl ether.

DESCRIPTION OF THE PREFERRED EMBODIMENTS

A heat sensitive recording material of the present invention has at least a heat sensitive color-forming layer on a support. The heat sensitive color-forming layer has 2,4-bis (phenylsulfonyl) phenol as an electron accepting compound, and 2-naphthylbenzyl ether and an amide compound as thermally fusible substances.

Hereinafter, the heat sensitive recording material of the present invention will be described in detail.

The heat sensitive recording material of the present invention has at least a heat sensitive color-forming layer on a support. The heat sensitive recording material may have a plurality of heat sensitive color-forming layers laminated on the support, and may have other layers such as an undercoat layer, or a protective layer, for example, as needed.

Heat Sensitive Color-Forming Layer

The heat sensitive color-forming layer has an electron donating colorless dye, an electron accepting compound, and thermally fusible substances. The heat sensitive color-forming layer may have other thermally fusible substances, image stabilizers and other such components as needed.

In the present invention, by the heat sensitive color-forming layer including 2,4-bis(phenylsulfonyl) phenol as the electron accepting compound, an image having high sensitivity and high degree of color formation is obtained. Further, by using 2-naphthylbenzyl ether and an amide compound which serve as the thermally fusible substances together with 2,4-bis(phenylsulfonyl) phenol, storage stability (including plasticizer resistance (resistance to solvents), water resistance, and heat resistance) in both image portions (i.e., color forming portions) and non-image portions (i.e., background portions) can be simultaneously improved. Accordingly, a high-density image can be obtained. Further, an image having excellent whiteness in background portions and having high contrast can be stably maintained for a long period of time.

Electron Accepting Compound

As described above, the heat sensitive recording material of the present invention contains 2,4-bis(phenylsulfonyl) phenol as an electron accepting compound which acts on the electron donating colorless dye to be described later, to form a color.

Other well-known electron accepting compounds may be used together with 2,4-bis(phenylsulfonyl) phenol as long as the effects of the present invention are not compromised.

The well-known electron accepting compounds can be appropriately selected in accordance with the purpose of the invention or the like. However, in order to suppress fog in background portions in particular, phenol compounds, or salicylic acid derivatives and salts of polyvalent metal thereof are preferable.

Examples of the phenol compounds include 2,2'-bis(4-hydroxyphenol) propane (bisphenol A), 4-t-butylphenol, 4-phenylphenol, 4-hydroxydiphenoxide, 1,1'-bis(4-hydroxyphenyl) cyclohexane, 1,1'-bis(3-chloro-4-hydroxyphenyl) cyclohexane, 1,1'-bis(3-chloro-4-hydroxyphenyl)-2-ethyl butane, 4,4'-sec-isooctylidenediphenol, 4,4'-sec-butyrylene diphenol, 4-tert-octylphenol, 4-p-methyphenylphenol, 4,4'-methylcyclohexylidenephenol, 4,4'-isopentylidenephenol, and p-hydroxybenzyl benzoate.

Examples of the salicylic acid derivatives include 4-pentadecylsalicylic acid, 3–5-di(α-methylbenzyl) salicylic acid, 3,5-di(tert-octyl) salicylic acid, 5-octadecylsalicylic acid, 5-α-(p-α-methylbenzylphenyl)

ethylsalicylic acid, 3-α-methylbenzyl-5-tert-octylsalicylic acid, 5-tetradecylsalicylic acid, 4-hexyloxysalicylic acid, 4-cyclohexyloxysalicylic acid, 4-decyloxysalicylic acid, 4-dodecyloxysalicylic acid, 4-pentadecyloxysalicylic acid, 4-octadecyloxysalicylic acid, and zinc, aluminum, calcium, copper, and lead salt thereof.

The total amount of the electron accepting compound is 50 to 500% by mass, and preferably 100 to 300% by mass, of the content (mass) of the electron donating colorless dye.

Further, when the well-known electron accepting compounds described above are used together with 2,4-bis (phenylsulfonyl) phenol in the present invention, the content of 2,4-bis(phenylsulfonyl) phenol according to the present invention is preferably 50% by mass or more, and particularly preferably 70% by mass or more, of the total amount of the electron accepting compounds.

The electron accepting compound is included in a coating solution for forming the heat sensitive color-forming layer. When the coating solution is prepared, the electron accepting compound is preferably used as a solid dispersion in a solvent.

In this case, the volume average particle diameter of the particles (i.e., the electron accepting compound) dispersed in a dispersion having the electron accepting compound is preferably 0.5 to 1.5 μm, and more preferably 0.5 to 1.0 μm. A volume average particle diameter of less than 0.5 μm may lead to an increase in the fog density of the background portions during storage. On the other hand, a volume average particle diameter exceeding 1.5 μm may lead to a decrease in heat sensitivity.

The volume average particle diameter can be easily measured with a laser-diffraction-type particle size distribution measuring device (for example, LA500 manufactured by Horiba, Ltd.).

Electron Donating Colorless Dye

The heat sensitive color-forming layer contains an electron donating colorless dye as a color-forming component which acts with the electron accepting compound to form a color.

The electron donating colorless dye is not particularly limited and can be appropriately selected from well-known dyes. In the present invention, examples of the electron donating colorless dye include, but are not limited to, the following compounds.

Examples of electron donating colorless dyes which form black include 3-di(n-butylamino)-6-methyl-7-anilinofluoran, 2-anilino-3-methyl-6-N-ethyl-N-sec-butylaminofluoran, 3-di(n-pentylamino)-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-(N-(3-ethoxypropyl)-N-ethylamino)-6-methyl-7-anilinofluoran, 3-di(n-butylamino)-7-(2-chloroanilino) fluoran, 3-diethylamino-7-(2-chloroanilino) fluoran, 3-diethylamino-6-methyl-7-anilinofluoran, and 3-(N-cyclohexyl-N-methylamino)-6-methyl-7-anilinofluoran.

Among these compounds, 3-di(n-butylamino)-6-methyl-7-anilinofluoran and 2-anilino-3-methyl-6-N-ethyl-N-sec-butylaminofluoran are preferable by preventing fog in non-image background portions.

Electron donating colorless dyes which form red or purplish red, orange, blue, green, and yellow can also be appropriately selected from among known compounds and used. These electron donating colorless dyes may be used individually, or two or more may be used in combination for color tone correction.

The electron donating colorless dye is included in a coating solution for forming the heat sensitive color-forming layer (hereinafter referred to as the "coating solution for the heat sensitive color-forming layer"). In the preparation of the coating solution, the electron donating colorless dye may be used as a solid dispersion in a solvent or used by being encapsulated in a heat responsive and/or pressure responsive microcapsule.

Many kinds of electron donating colorless dyes can be appropriately selected so that a heat sensitive recording material forming multiple colors is obtained. Specifically, a heat sensitive recording material forming multiple colors can be manufactured, for example, by including electron donating colorless dyes which each form a color of distinct hue in respective layers to form a laminated structure having two or more heat sensitive color-forming layers. Alternatively, two or more types of electron donating colorless dyes can be separately encapsulated in different types of microcapsules to form heat sensitive color-forming layers.

The heat sensitive color-forming layer including the electron donating colorless dye is provided by, for example, applying a coating solution for the heat sensitive color-forming layer onto a support. The amount of the electron donating colorless dye included in the heat sensitive color-forming layer is preferably 0.1 to 1.0 g/m$^2$, and more preferably 0.2 to 0.5 g/m$^2$, in terms of the degree of color formation and the fog density of background portions.

A method of microencapsulating a color-forming component can be appropriately selected from known conventional methods and used. A preferable example is an interfacial polymerization method. In this method, an oil phase, which is prepared by dissolving or dispersing a color-forming component (for example, an electron donating dye precursor) in a hydrophobic organic solvent which forms a core of a capsule, is mixed with a water phase in which a water-soluble polymer is dissolved, and the resulting mixture is emulsified and dispersed by a homogenizer. Subsequently, by increasing the temperature, a polymer forming reaction is generated at the interface of oil droplets of the emulsion, thereby forming a microcapsule wall made of high molecular substances. The interfacial polymerization method is useful in that capsules having a uniform particle diameter can be formed in a short time and a heat sensitive recording material having excellent shelf life can be obtained.

Thermally Fusible Substances

As described above, the heat sensitive recording material of the present invention contains 2-naphthylbenzyl ether and an amide compound as thermally fusible substances.

The amide compound can be appropriately selected from well-known compounds. Examples of the amide compounds include palmitic acid amide, stearic acid amide, behenic acid amide, hydroxystearic acid amide, methylolstearic acid amide, methylolbehenic acid amide, methylenebisstearic acid amide, ethylenebisstearic acid amide, and ethylenebisbehenic acid amide.

Among these compounds, stearic acid amide, ethylenebisstearic acid amide, and methylolstearic acid amide are preferable.

The content of the amide compound is preferably 2 to 100 parts by mass, and more preferably 10 to 50 parts by mass with respect to 100 parts by mass of 2-naphthylbenzyl ether.

If the content of the amide compound is less than 2 parts by mass, high density may not be obtained. If, however, the content exceeds 100 parts by mass, the fog density of background portions may increase (i.e., storage stability in background portions may deteriorate) when the heat sensitive recording material is stored at high temperatures and high humidities.

Further, in addition to 2-naphthylbenzyl ether and the amide compound, other well-known thermally fusible substances may be used as long as the effects of the present invention are not compromised.

Examples of the well-known thermally fusible substances include stearyl urea, p-benzylbiphenyl, di(2-methylphenoxy) ethane, di(2-methoxyphenoxy) ethane, β-naphtol-(p-methylbenzyl) ether, α-naphthylbenzyl ether, 1,4-butanediol-p-methylphenyl ether, 1,4-butanediol-p-isopropylphenyl ether, 1,4-butanediol-p-tert-octylphenyl ether, 1-phenoxy-2-(4-ethylphenoxy) ethane, 1-phenoxy-2-(chlorophenoxy) ethane, 1,4-butanediolphenyl ether, diethylene glycolbis(4-methoxyphenyl) ether, m-terphenyloxalic acid methylbenzyl ether, 1,2-diphenoxymethylbenzene, 1,2-bis(3-methylphenoxy) ethane, and 1,4-bis(phenoxymethyl) benzene.

The total amount of the thermally fusible substances included in the heat sensitive color-forming layer is preferably 75 to 200 parts by mass, and more preferably 100 to 150 parts by mass with respect to 100 parts by mass of the electron accepting compound.

When the well-known thermally fusible substance is used together with 2-naphthylbenzyl ether and the amide compound, the sum of the contents of 2-naphthylbenzyl ether and the amide compound is preferably 50% by mass or more, and particularly 70% by mass or more, of the total content of the thermally fusible substances.

Other Components

The heat sensitive color-forming layer may further include other components such as an image stabilizer.

Image Stabilizer

The image stabilizer can be appropriately selected from well-known compounds. Phenol compounds, particularly polymeric hindered phenol compounds are effective.

Examples of the image stabilizers include 1,1,3-tris(2-methyl-4-hydroxy-tert-butylphenyl) butane, 1,1,3-tris(2-ethyl-4-hydroxy-5-tert-butylphenyl) butane, 1,1,3-tris(3,5-di-tert-butyl-4-hydroxyphenyl) butane, 1,1,3-tris(2-methyl-4-hydroxy-5-tert-butylphenyl) propane, 2,2'-methylene-bis(6-tert-butyl-4-methylphenol), 2,2'-methylene-bis(6-tert-butyl-4-ethylphenol), 4,4'-butylidene-bis(6-tert-butyl-3-methylphenol), and 4,4'-thio-bis(3-methyl-6-tert-butylphenol).

The content of the image stabilizer is preferably 10 to 100 parts by mass, and more preferably 30 to 60 parts by mass, with respect to 100 parts by mass of the electron donating colorless dye. If the content is less than 10 parts by mass, desired effects regarding fog in background portions and image storability may not be obtained. If the content exceeds 100 parts by mass, sufficient sensitivity may not be obtained.

Other

When components other than the electron donating colorless dye, the electron accepting compound, and the thermally fusible substances are used as a dispersion, dispersion thereof is suitably carried out in a water-soluble binder.

A compound of which an amount of 5% by mass or more dissolves in water having a temperature of 25° C. is preferable as the water-soluble binder. Examples include polyvinyl alcohol, methyl cellulose, carboxymethyl cellulose, starch (including modified starch), gelatin, gum arabic, casein, and a saponified product of a styrene-maleic anhydride copolymer.

The water-soluble binder is used for the purpose of not only dispersion but also improving the film strength of the heat sensitive color-forming layer formed. In order to further improve the film strength, synthetic, high molecular latex-based binders such as a styrene-butadiene copolymer, a vinyl acetate copolymer, an acrylonitrile-butadiene copolymer, a methyl acrylate-butadiene copolymer, and polyvinylidene chloride can also be used together with the water-soluble binder.

Components other than the electron donating colorless dye, the electron accepting compound, and the thermally fusible substances are dispersed together or individually by a stirrer and a grinder such as a ballmill, an attritor, and a sandmill, and are ultimately prepared as a coating solution. Various types of pigments, metallic soap, wax, surfactants, antistatic agents, ultraviolet ray absorbents, antifoaming agents, and fluorescent dyes may also be added to the coating solution as needed.

Examples of the pigments include calcium carbonate, barium sulfate, lithopone, agalmatolite, kaolin, calcined kaolin, amorphous silica, and aluminum hydroxide.

Examples of the metallic soaps include higher fatty acid metallic salt, and specifically, zinc stearate, calcium stearate, and aluminum stearate.

Examples of the waxes include paraffin wax, microcrystalline wax, carnauba wax, methylol stearoamide, polyethylene wax, polystyrene wax, and fatty acid-based wax. These waxes may be used alone, or a combination of two or more may be used.

Examples of the surfactants include sulfosuccinic acid-based alkali metallic salts and fluorine-containing surfactants.

After the components have been dispersed in a water-soluble binder and prepared as a coating solution as described above, the coating solution is applied onto a support in accordance with a well-known application method. After the application and drying, the coating solution is subjected to a smoothing treatment by using a calender to obtain a heat sensitive material. The amount of the coating solution applied to form the heat sensitive color-forming layer is not particularly limited. However, the preferable amount is usually about 2 to 7 $g/m^2$ in dry mass.

The well-known application method is not particularly limited. Examples of the application method include those using an air knife coater, a roll coater, a blade coater, and a curtain coater. Among these methods, the method in which a curtain coater is used is particularly preferable.

Support

A conventionally known support can be used as the support. Specific examples of the support include a paper support such as high quality paper, coated paper in which a resin or pigment is coated on paper, paper laminated with a resin, high quality paper having an undercoat layer, recycled paper having an undercoat layer, synthetic paper, and a plastic film.

As the support, a smooth support having a smoothness of 300 seconds or more, which smoothness is specified in JIS-8119, is preferable from the standpoint of dot reproduction.

As described above, an undercoat layer may be provided on the support. When an undercoat layer is provided on the support, an undercoat layer including a pigment as a main component is preferably provided.

Although any of the general inorganic and organic pigments can be used as the pigment, a pigment whose oil absorbency is 40 ml/100 g (40 cc/100 g) or more, which oil absorbency is specified in JIS-K5101, is particularly preferable. Specific examples include calcium carbonate, barium sulfate, aluminum hydroxide, kaolin, calcined kaolin, amorphous silica, and urea formalin resin powder. Among these, a pigment having an oil absorbency of 70 ml/100 g or more is particularly preferable.

The amount of the pigment applied is preferably 2 g/m$^2$ or more, more preferably 4 g/m$^2$ or more, and most preferably 7 to 12 g/m$^2$.

Examples of binders for the undercoat layer include water-soluble polymers and water-soluble binders. These binders may be used alone, or a combination of two or more may be used.

Examples of the water-soluble polymers include starch, polyvinyl alcohol, polyacrylamide, carboxymethyl alcohol, methyl cellulose, and casein. Examples of common water-soluble binders are synthetic rubber latex and synthetic resin emulsion. Specific examples include a styrene-butadiene rubber latex, an acrylonitrile-butadiene rubber latex, a methyl acrylate-butadiene rubber latex, and an emulsion of vinyl acetate.

Further, wax, a color fading inhibitor, a surfactant, and the like may be added to the undercoat layer.

The content of the binder is preferably 3 to 100% by mass, more preferably 5 to 50% by mass, and most preferably 8 to 15% by mass with respect to the pigment added to the undercoat layer.

A well-known application method can be used to form the undercoat layer. For example, application methods using an air knife coater, a roll coater, a blade coater, a gravure coater, or a curtain coater can be used. Among these application methods, a method using a blade coater is preferable.

In addition, a smoothing treatment such as one using a calender may be applied as needed.

Other Layers

A protective layer can be provided on the heat sensitive color-forming layer if necessary. The protective layer contains organic or inorganic micropowders, a binder, a surfactant, a thermally fusible substance, and the like.

Examples of the micropowders include inorganic micropowders such as micropowders of calcium carbonate, silica, zinc oxide, titanium oxide, aluminum hydroxide, zinc hydroxide, barium sulfate, clay, talc, and surface-treated calcium and silica, and organic micropowders such as micropowders of a urea-formalin resin copolymer, a styrene-metacrylic acid copolymer, and polystyrene.

Examples of the binder for the protective layer include polyvinyl alcohol, carboxy modified polyvinyl alcohol, a vinyl acetate-acrylamide copolymer, silicon modified polyvinyl alcohol, starch, modified starch, methyl cellulose, carboxymethyl cellulose, hydroxymethyl cellulose, gelatins, gum arabic, casein, a hydrolysate of a styrene-maleic acid copolymer, a polyacrylamide derivative, polyvinyl pyrrolidone, and latexes such as a styrene-butadiene rubber latex, an acrylonitrile-butadiene rubber latex, a methyl acrylate-butadiene rubber latex, and an emulsion of vinyl acetate.

Moreover, the binder may be crosslinked, and a water-resisting agent may be added to the crosslinked binder in order to further improve storage stability of the heat sensitive recording material. Examples of the water-resisting agents include water-soluble initial condensation products such as N-methylolurea, N-methylolmelamine, and urea-formalin, dialdehyde compounds such as glyoxal and glutaraldehyde, inorganic crosslinking agents such as boric acid, borax, and colloidal silica, and polyamide epichlorohydrin.

EXAMPLES

The present invention will now be described by, but is not limited to, the following Examples. Hereinafter, "part(s)" and "%" described in Examples represent "part(s) by mass" and "% by mass", respectively. The volume average particle diameter was measured by using a laser-diffraction-type particle size distribution measuring device LA500 (manufactured by Horiba, Ltd.).

Example 1

Formation of Heat Sensitive Recording Material

Preparation of Coating Solution for Heat Sensitive Color-forming Layer

Preparation of Dispersion Liquid A

The following components were respectively dispersed by using a sand mill to obtain a dispersion liquid A having a volume average particle diameter of 1.0 $\mu$m.

| [Composition of dispersion liquid A] | |
|---|---|
| 3-dibutylamino-6-methyl-7-anilinofluoran (electron donating colorless dye) | 10 parts |
| 10% aqueous solution of polyvinyl alcohol (PVA-105, produced by Kuraray Co., Ltd.) | 15 parts |
| Water | 25 parts |

Preparation of Dispersion Liquid B

The following components were respectively dispersed by using a sand mill to obtain a dispersion liquid B having a volume average particle diameter of 1.0 $\mu$m.

| [Composition of dispersion liquid B] | |
|---|---|
| 2,4-bis(phenylsulfonyl) phenol (electron accepting compound) | 20 parts |
| 2-naphtylbenzyl ether | 20 parts |
| 10% aqueous solution of polyvinyl alcohol (PVA-105) | 60 parts |
| Water | 100 parts |

Preparation of Dispersion Liquid C

The following components were respectively dispersed by using a sand mill to obtain a dispersion liquid C having a volume average particle diameter of 1.5 $\mu$m.

| [Composition of dispersion liquid C] | |
|---|---|
| Light duty calcium carbonate | 25 parts |
| 40% aqueous solution of polyacrylic soda | 0.25 parts |
| Hexametaphosphoric acid soda | 0.25 parts |
| Water | 34.5 parts |

Compounds having the following compositions were mixed to obtain a coating solution for a heat sensitive color-forming layer (2-naphthylbenzyl ether:amide compound=100:5).

| [Composition of coating solution for heat sensitive color-forming layer] | |
|---|---|
| Dispersion liquid A | 50 parts |
| Dispersion liquid B | 200 parts |
| Dispersion liquid C | 60 parts |
| 30% dispersion liquid of zinc stearate | 10 parts |
| 30% dispersion liquid of paraffin wax | 20 parts |
| 20% dispersion liquid of stearic acid amide | 5 parts |
| 50% aqueous solution of fluorescent brightening agent | 1 part |
| 10% aqueous solution of polyvinyl alcohol (PVA-117, produced by Kuraray Co., Ltd.) | 40 parts |

Formation of Heat Sensitive Recording Material

In order to manufacture a base paper having an undercoat thereon, an undercoat layer was formed on a base paper having a basic weight of 60 g/m$^2$ by using a blade coater to apply a coating solution which contained a pigment and a binder as main components, such that the amount of the coating solution applied was 10 g/m$^2$ after drying. Subsequently, the coating solution for the heat sensitive color-forming layer obtained as described above was applied by a curtain coater onto the undercoat layer of the base paper and was dried such that the amount of the coating solution applied for the heat sensitive color-forming layer was 4 g/m$^2$ after drying. A calender treatment was carried out on the surface of the heat sensitive color-forming layer which has been formed to obtain a heat sensitive recording material (1) of the present invention.

Example 2

A heat sensitive recording material (2) of the present invention was manufactured in the same way as in Example 1, except that an air knife coater was used in place of the curtain coater to apply the coating solution for the heat sensitive color-forming layer.

Example 3

A heat sensitive recording material (3) of the present invention was manufactured in the same way as in Example 1, except that 50 parts of a 20% dispersion liquid of ethylenebisstearic acid amide was used in place of the 5 parts of the 20% dispersion liquid of stearic acid amide to prepare the coating solution for the heat sensitive color-forming layer (2-naphthylbenzyl ether:the amide compound=100:50).

Example 4

A heat sensitive recording material (4) of the present invention was manufactured in the same way as in Example 1, except that the 20% dispersion liquid of stearic acid amide used to prepare the coating solution for the heat sensitive color-forming layer was used in an amount of 100 parts in place of 50 parts (2-naphthylbenzyl ether:the amide compound=100:100).

Comparative Example 1

A heat sensitive recording material (5) of Comparative Example was manufactured in the same way as in Example 1, except that bisphenol A was used in place of 2,4-bis (phenylsulfonyl) phenol to prepare the coating solution for the heat sensitive color-forming layer (2-naphthylbenzyl ether:the amide compound=100:5).

Comparative Example 2

A heat sensitive recording material (6) of Comparative Example was manufactured in the same way as in Example 1, except that the 20% dispersion liquid of stearic acid amide was not used in the preparation of the coating solution for the heat sensitive color-forming layer (2-naphthylbenzyl ether:the amide compound=100:0).

Comparative Example 3

A heat sensitive recording material (7) of Comparative Example was manufactured in the same way as in Example 1, except that 2-naphtylbenzyl ether was not used in the preparation of the dispersion liquid B (2-naphthylbenzyl ether:the amide compound=0:100).

Comparative Example 4

A heat sensitive recording material (8) of Comparative Example was manufactured in the same way as in Example 1, except that 150 parts of a 20% dispersion liquid of ethylenebisstearic acid amide was used in place of the 5 parts of the 20% dispersion liquid of stearic acid amide to prepare the coating solution for the heat sensitive color-forming layer (2-naphthylbenzyl ether:the amide compound=100:150).

Comparative Example 5

A heat sensitive recording material (9) of Comparative Example was manufactured in the same way as in Example 1, except that m-terphenyl was used in place of 2-naphthylbenzyl ether to prepare the dispersion liquid B (2-naphthylbenzyl ether:the amide compound=100:5).

Evaluation

Sensitivity and storage stability (heat resistance, humidity resistance, and plasticizer resistance) for the heat sensitive recording materials (1) to (9) obtained above were evaluated. The density of non-printing portions (i.e., background portions) of the respective unprocessed (i.e., unused) heat sensitive recording materials was measured by a Macbeth reflection densitometer (RD-918, manufactured by Gretag-Macbeth LLC) as a reference fog value of the density of non-image portions (i.e., background fog).

The results of measurement and evaluation are given in Table 1 below.

(1) Sensitivity

By using a thermal printing apparatus which has a thermal head (KJT-216-8MPD1 manufactured by Kyocera Corporation) and a pressure roll disposed immediately ahead of the thermal head and having a pressure of 100 kg/cm$^2$, printing was carried out under the conditions of a head voltage of 24 V, a pulse cycle of 10 ms, and a pulse width of 2.1 ms. The printing density of printed portions was measured by using the Macbeth reflection densitometer (RD-918), and the measured value was used as the index of sensitivity. The larger the value, the higher the sensitivity.

The printing density was also used as the reference printing density in the following evaluation of storage stability.

(2) Storage Stability

Heat Resistance

The respective heat sensitive recording materials which were subjected to printing were stored for 24 hours in a 60° C. and 30% RH environment. Subsequently, the printing density of the printed portions and the density of the background portions of each heat sensitive recording material were measured by the Macbeth reflection densitometer RD-918 and used as the indices of heat resistance. The larger the density of the printed portions, the smaller the variation from the reference density, and therefore, the better the heat resistance. The smaller the density of the background portions, the smaller the variation from the reference fog value, and therefore, the better the heat resistance.

Humidity Resistance

The respective heat sensitive recording materials which were subjected to printing were stored for 24 hours in a 40° C. and 90% RH environment. Subsequently, the printing density of the printed portions and the density of the background portions of each heat sensitive recording material were measured by the Macbeth reflection densitometer RD-918 and used as the indices of humidity resistance. As in the above evaluation, the larger the density of the printed portions and the smaller the density of the background portions, the smaller the variation in the densities, and therefore, the better the humidity resistance.

Plasticizer Resistance

Each of the heat sensitive recording materials which were subjected to printing was stored for 24 hours in a 25° C. environment while contacting a commercially available vinyl chloride sheet (Polymerwrap produced by Shin-Etsu Polymer Co., Ltd.). Subsequently, the printing density of the printed portions and the density of the background portions of each heat sensitive recording material were measured by the Macbeth reflection densitometer RD-918 and used as the indices of plasticizer resistance. As in the above evaluations, the larger the density of the printed portions and the smaller the density of the background portions, the smaller the variation in the densities, and therefore, the better the plasticizer resistance.

TABLE 1

| | Heat sensitive recording material | Sensitivity | Fog density | Heat resistance | | Humidity resistance | | Plasticizer resistance | |
|---|---|---|---|---|---|---|---|---|---|
| | | | | Printed portions | Background portions | Printed portions | Background portions | Printed portions | Background portions |
| Example 1 | (1) | 1.30 | 0.06 | 1.27 | 0.14 | 1.28 | 0.13 | 1.26 | 0.06 |
| Example 2 | (2) | 1.27 | 0.06 | 1.25 | 0.14 | 1.25 | 0.13 | 1.24 | 0.06 |
| Example 3 | (3) | 1.29 | 0.07 | 1.28 | 0.14 | 1.27 | 0.13 | 1.27 | 0.06 |
| Example 4 | (4) | 1.33 | 0.10 | 1.32 | 0.16 | 1.31 | 0.15 | 1.25 | 0.05 |
| Comparative Example 1 | (5) | 1.35 | 0.06 | 1.01 | 0.08 | 1.35 | 0.06 | 0.50 | 0.04 |
| Comparative Example 2 | (6) | 1.24 | 0.05 | 1.25 | 0.13 | 1.23 | 0.13 | 1.23 | 0.04 |
| Comparative Example 3 | (7) | 1.18 | 0.05 | 1.18 | 0.12 | 1.19 | 0.12 | 1.16 | 0.05 |
| Comparative Example 4 | (8) | 1.34 | 0.15 | 1.33 | 0.22 | 1.32 | 0.20 | 1.20 | 0.04 |
| Comparative Example 5 | (9) | 1.24 | 0.05 | 1.23 | 0.13 | 1.24 | 0.12 | 1.20 | 0.04 |

It can be seen from the results of Table 1 that, in the case of the heat sensitive recording materials (1) to (4) in which the heat sensitive color-forming layer contained 2,4-bis (phenylsulfonyl) phenol as an electron accepting compound, and 2-naphthylbenzyl ether and an amide compound were used together as thermally fusible substances, the degree of color formation and the whiteness of the background portions were high, and an image of high contrast could be obtained. Further, the heat sensitive recording materials (1) to (4) also had excellent storage stability (plasticizer resistance (resistance to solvents), humidity resistance, and heat resistance) in both the printed portions and the non-printed portions (i.e., the background portions).

On the other hand, the printed portions of the heat sensitive recording material (5), in which 2,4-bis (phenylsulfonyl) phenol was not used as an electron accepting compound, had poor color fastness when the heat sensitive recording material was stored at high temperatures and in contact with a plasticizer. Therefore, sufficient image storability could not be obtained. Further, sufficient degree of color formation was not obtained in the heat sensitive recording materials (6), (7), and (9) in which two types of thermally fusible substances, namely, 2-naphthylbenzyl ether and an amide compound, were not used together. Moreover, the fog density increased in the high temperature and high humidity environment and in the presence of a plasticizer, and the background portions of these recording materials had poor storage stability. In the heat sensitive recording material (8) in which the two specified types of thermally fusible substances were used together but the amount of the amide compound was larger than that of 2-naphthylbenzyl ether, the fog density in the background portions could not be suppressed to a low value.

In accordance with the present invention, a heat sensitive recording material which has high sensitivity and high degree of color formation, excellent storage stability in image portions and non-image portions (i.e., background portions), high whiteness in background portions, and can stably maintain a high contrast image for a long period of time can be provided.

What is claimed is:

1. A heat sensitive recording material comprising a heat sensitive color-forming layer disposed on a support, the layer having an electron donating colorless dye and an electron accepting compound, wherein at least one type of the electron accepting compound is 2,4-bis(phenylsulfonyl) phenol, and the heat sensitive color-forming layer further has 2-naphthylbenzyl ether and an amide compound as thermally fusible substances, wherein the amide compound is selected from the group consisting of behenic acid amide, hydroxystearic acid amide, methylolstearic acid amide, methylolbehenic acid amide, methylenebisstearic acid amide, ethylenebisstearic acid amide, and ethylenebisbehenic acid amide, and the amount of amide compound does not exceed the amount of 2-naphthylbenzyl ether.

2. The heat sensitive recording material of claim 1, wherein the amide compound is methylolstearic acid amide.

3. The heat sensitive recording material of claim 1, wherein the amide compound is ethylenebisstearic acid amide.

4. The heat sensitive recording material of claim 1, wherein the content of the amide compound is 2 to 100 parts by mass with respect to 100 parts by mass of 2-naphthylbenzyl ether.

5. The heat sensitive recording material of claim 1, wherein the content of 2,4-bis(phenylsulfonyl) phenol is no less than 50% by mass of the total amount of the electron accepting compound.

6. The heat sensitive recording material of claim 1, wherein the electron accepting compound has a volume average particle diameter of 0.5 to 1.5 $\mu$m.

7. The heat sensitive recording material of claim 1, wherein the total amount of the thermally fusible substances is 75 to 200 parts by mass with respect to 100 parts by mass of the electron accepting compound.

* * * * *